United States Patent [19]

Hinsperger

[11] 4,192,025

[45] Mar. 11, 1980

[54] COVER FOR SWIMMING POOL

[76] Inventor: Cornelius A. Hinsperger, 1749 Mattawa Ave., Mississauga, Ontario, Canada, L4X 1K5

[21] Appl. No.: 933,679

[22] Filed: Aug. 14, 1978

[30] Foreign Application Priority Data

Jul. 12, 1978 [CA] Canada ..... 307263

[51] Int. Cl.[2] ..... E04H 3/16; E04H 3/18

[52] U.S. Cl. ..... 4/172.14

[58] Field of Search ..... 4/172.12, 172.13, 172.14, 4/172

[56] References Cited

U.S. PATENT DOCUMENTS

| | | | |
|---|---|---|---|
| 3,683,428 | 8/1972 | Morris | 4/172.14 |
| 3,748,664 | 7/1973 | Morita | 4/172.14 |

*Primary Examiner*—Houston S. Bell, Jr.

*Attorney, Agent, or Firm*—Browdy and Neimark

[57] ABSTRACT

A thermal blanket or cover for a swimming pool. The blanket consists of a covering of flexible plastic sheet material to which are secured strips of foam-backed plastic sheet material to provide flotation and reinforcement.

24 Claims, 4 Drawing Figures

COVER FOR SWIMMING POOL

The present invention relates to a flexible blanket or cover for a swimming pool or other body of water which, with regular use, will maintain the temperature of the water in the pool warmer, cleaner, and more economical to maintain. The use of the blanket will save water, chemicals, and even fuel if the pool is heated.

The present blanket is manufactured of plastic sheet material which is provided with flotation and reinforcement strips enabling the blanket to float on the surface of the water and while one prime object of the invention is to provide for pool heat retention and pool heating as a result of solar heat, the presence of the blanket minimizes water evaporation and also catches debris, leaves, and the like. Use of the blanket also minimizes water loss through evaporation and saves on the use of pool maintenance chemicals.

The blanket of the invention may be of any desired shape such as round, oval, or of any rectilinear configuration and may be manufactured in sizes to suit standard pool sizes or may be made to cover the water in pools of irregular configuration.

The principal covering is plastic sheet material preferably of non-ripping plastic fabric sheeting, and flotation for the blanket is provided by strips of foam-backed plastic sheet material. The foam-backing on the strips is buoyant itself, and additional buoyancy is provided by pockets of air trapped within the foam structure. The blanket is preferably stabilized against ultraviolet light to ensure useful and long life.

DESCRIPTION OF THE PRIOR ART

U.S. Pat. 3,872,522 granted Mar. 25, 1975 to Robert Bennett etal relates to a Protective Cover for Pools consisting of a number of relatively inflexible molded panels adapted to together cover the surface of water in a swimming pool to reduce water evaporation and to catch debris.

U.S. Pat. No. 3,940,809 granted to G. A. Hughes, on Mar. 2, 1976, relates to a Swimming Pool Cover consisting of an air filled loop which peripherally encloses a plastic sheet and which is adapted to prevent evaporation and heat loss.

Although both of these U.S. Patents effectively satisfy their objectives, the difficulty with respect to the Bennet proposal is the time and labour required to place and then to remove the individual panels, and the panels once removed from the pool do not lend themselves to easy storage.

The effectiveness of the proposal of Hughes is dependent upon the buoyancy factor of the peripheral ring. in usse, the ring is subjected to numerous abrasion factors and any rupture of the air-filled ring may result in sufficient loss of buoyancy to render the structure ineffective. Storage is also a disadvantage.

OBJECTS OF THE INVENTION

The object of the invention is to provide a thermal blanket for flotation on the surface of water in a swimming pool and which is of flexible, light one-piece manufacture which simplifies positioning and removal and which may be folded compactly for storage, and which is economical in manufacture and durable in use.

This object is achieved by the invention which provides a thermal covering consisting principally of flexible plastic sheet material provided with flexible flotation and reinforcing strips secured thereto. The strips are foam-backed flexible plastic sheet material with flotation being provided by the foam-backing which is not subject to loss of buoyancy as a result of hard usage. The flexible nature of the covering also simplifies positioning and removal and the covering may be compactly folded for storage.

BRIEF DESCRIPTION OF ACCOMPANYING DRAWINGS

The inventive concept will now be more specifically discussed with reference to the accompanying drawings wherein.

SPECIFIC DESCRIPTION OF ACCOMPANYING DRAWINGS

Figure 1:
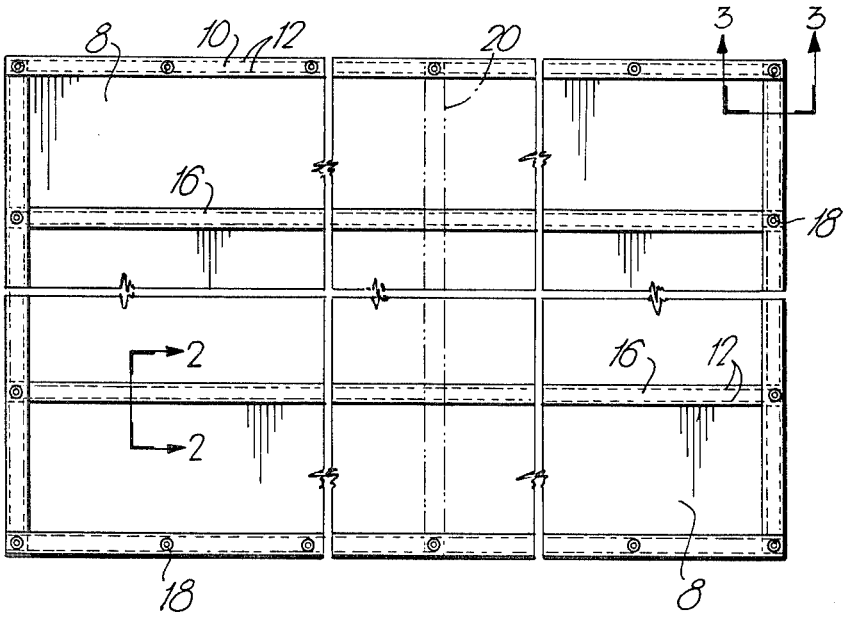
FIG. 1 illustrates in plan view one embodiment of the blanket or cover of the present invention.
Figure 4:
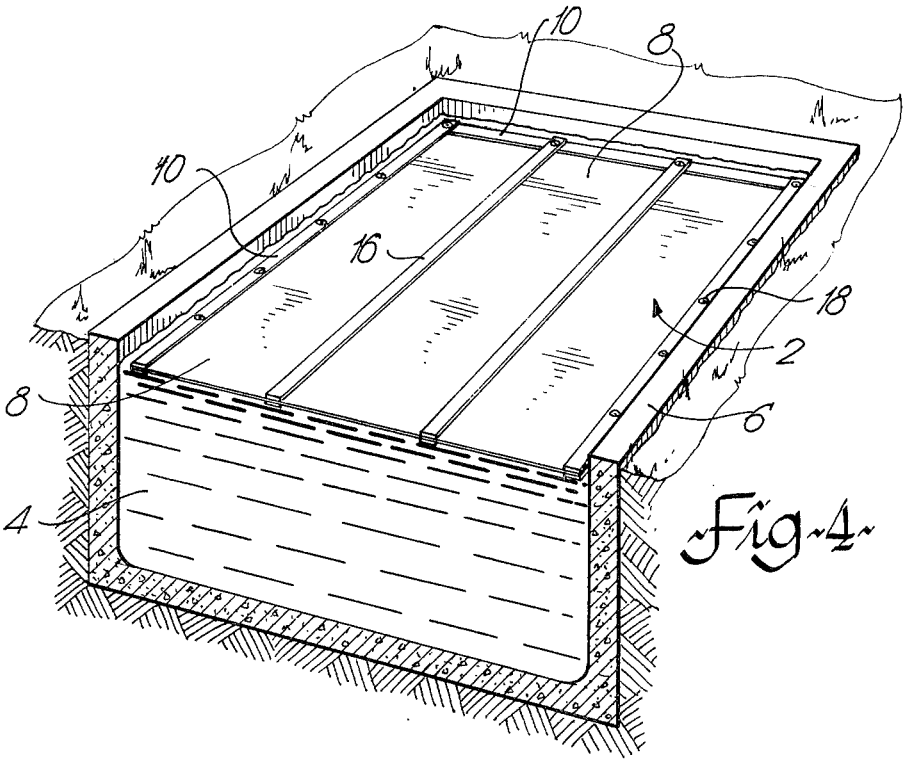
FIG. 4 is a perspective partially sectioned view showing the cover of the invention in position and floating on the water in a swimming pool.

FIG. 1 shows the present cover or blanket shown generally at 2 in top view, and FIG. 4 illustrates in perspective view the cover in position floating on the water 4 in a swimming pool shown generally by numeral 6.

The blanket consists of plastic sheet material 8 having strips 10 of foam-backed plastic sheet secured thereto at least around the periphery of the blanket to provide flotation. The peripherally positioned strips 10 of foam-backed plastic sheet are preferably stitched to the sheet material 8 in a manner as shown at 12 in FIG. 3.

Figure 3:
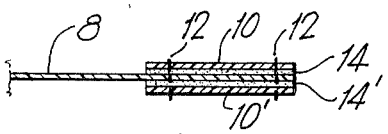
FIG. 3 is a sectional view along line 3—3 of FIG. 1.

Preferably, and around the periphery of the blanket upper and lower strips 10 and 10' are provided as shown in FIG. 3. The foam-backing 14 of the upper strips 10 faces the plastic sheet material 8 whereas the foam-backing 12' on the lower strips 10' also faces the plastic sheet material 8 as shown. These strips 10 and 10' are preferably secured to the plastic sheet material 8 by parallel rows of stitching as shown at 12.

Securement could be by adhesives or by heat sealing along the edges of the strips but securement by stitching is preferred.

Depending upon the size of the pool, strips of foam-backed plastic material 16 may also be provided extending across the blanket from edge to edge as shown in FIGS. 1 and 4.

Figure 2:
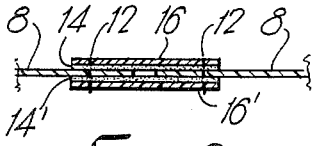
FIG. 2 is a sectional view along line 2—2 of FIG. 1.

These strips 16, if the pool blanket is made from a single piece of plastic material may be simply stitched to the material or alternatively the strips 16 may be used to secure longitudinal strips of material 8 together in a manner as shown in FIG. 2. Similarly, with the peripheral strips 10, upper and lower interior strips 16 and 16' are preferably provided and these latter strips are secured to the blanket sections by parallel rows of stitching as shown at 12 in FIG. 2.

In addition to providing flotation to the blanket the strips 10, 10' of foam-backed material provide reinforcement to the blanket around the periphery thereof. The interior strips 16, 16' provide interior flotation and reinforcement and also act to secure adjacent blanket sections 8 together.

The sheet material 8 and the strips 10, 10' 16, 16' are preferably of tear resistant woven and laminated plastic sheet of the variety available under the registered trade mark RIP-STOP, and the material also preferably is stabilized against deterioration by ultra-violet light rays from the sun. The preferred material is ultra-violet light stabilized woven and laminated polyethylene sheet.

It has been found that strips 10 and 16, and in preferred manufacture, strips 10, 10' 16 and 16' provide the necessary buoyancy. However, if additional buoyancy is desired additional peripheral and interior strips can be added. By way of example, the periphery of the covering could have four thicknesses of foam-backed peripheral strips and the interior strips could be of multiple thickness.

As indicated above, the pool blanket can be of any size or shape. However, the manufacture of one blanket will now be described.

Sheets of tear resistant ultra-violet stabilized plastic sheet material of a size 12 feet long by 72 inches wide are positioned side by side in a manner as shown in FIG. 1. Three such sheets are used to provide a pool 12 feet long with a width of 18 feet.

The sheet sections so positioned are then secured together utilizing interior strips 16, 16' which are attached to the sheet sections by stitching 12 as clearly shown in FIG. 2.

Peripheral strips 10, 10' are then secured by stitching as shown at 12 in FIG. 3 to complete the cover. The strips 10, 10' 16, 16' can conveniently be secured to the sections 8 using a two-needle machine.

It will be appreciated that the width of the reinforcement and flotation strips can be of any suitable size but it has been found that the use of two inch strips of foam-backed material arranged in the manner as shown in FIG. 1 provides the required flotation and reinforcement.

In use one or more buckets of water may be poured on the blanket to hold it down against the water of the pool surface, and prevent movement of the pool blanket. As shown in FIG. 1, grommets 18 may be provided around the blank so that the pool cover can be secured fastened if desired.

As suggested earlier, suitable plastic material for the pool blanket is woven and laminated polyethylene sheet material which is resistant to tearing. The panels 8 and the strips 10, 10', 16, and 16' may suitably be made of this woven and laminated polyethylene material and in the case of the strips foam-backing is provided thereon. It will be appreciated, however, that other plastic sheet material could be used in accordance with the present invention.

To provide greater length, the sheet sections may be laid end-to-end and secured together using interior flotation strips 20 shown in broken lines in FIG. 1.

The foam backing 14, 14' provided on the strips need only be a thin layering to provide the required flotation. In this connection, it will be appreciated that the present cover is not intended as a buoyancy device or a safety restraint and should not be used nor intended for use in any such capacity.

I claim:

1. A lightweight thermal cover or blanket for a swimming pool which is compactly foldable for storage comprising thin and flexible plastic sheeting, thin flexible strips of plastic sheet material secured to said plastic sheeting, said thin flexible strips having sides thereof facing said plastic sheeting provided with a thin and flexible layer of closed cell foam material thereon, said strips being spaced over a major surface of said plastic sheeting and around peripheral edges thereof to provide reinforcement and flotation.

2. Blanket or cover according to claim 1, wherein said strips are secured to the said sheeting by stitching.

3. Blanket or cover according to claim 1, which is of circular or oval configuration, and wherein one of said strips is a peripheral strip of thin and flexible plastic sheet material having a thin and flexible layer of closed cell foam material provided thereon and is secured around a border of the cover on one side thereof.

4. Blanket or cover according to claim 1, which is of rectilinear configuration and wherein at least some of said strips of thin and flexible plastic sheet material around said peripheral edges and having thin and flexible layers of closed cell foam material provided thereon are secured to one side of the cover along edges thereof.

5. Blanket or cover according to claim 4, wherein at least some of said strips of the thin and flexible plastic sheet material extend across the cover form edge to edge on one side thereof.

6. Blanket or cover according to claim 1, wherein at least some of said strips of the plastic sheet material are secured to the sheeting on opposite sides thereof.

7. Blanket or cover according to claim 3, wherein at least one of said strips of thin and flexible plastic sheet material is secured peripherally around said border of said sheeting on an opposite side thereof.

8. Blanket or cover according to claim 4, wherein some of said strips of plastic material are secured to said sheeting around said edges thereof on an opposite side of said sheeting.

9. A lightweight thermal cover for a swimming pool which is compactly foldable for storage comprising panels of thin and flexible plastic sheeting secured together in edgewise relationship by thin and flexible strips of plastic sheet material, said strips overlapping edges of adjacent ones of said panels, sides of said strips facing said panels having a thin and flexible layer of closed cell foam material provided thereon, and having additional strips of thin flexible plastic sheet material secured around peripheral edges of the cover, said strips and said additional strips providing reinforcement and flotation.

10. A lightweight thermal cover for a swimming pool which is completely foldable for storage comprising panels of thin and flexible plastic sheeting secured together in edgewise relationship by thin flexible strips of plastic sheet material, said strips being provided on both sides of said panels and overlapping edges of adjacent ones of said panels with sides of said strips facing said panels having a thin and flexible layer of closed cell foam material provided thereon, and additional flexible strips of plastic sheet material being secured around peripheral edges of the cover on both sides thereof, said strips and said additional strips providing reinforcement and flotation.

11. A cover according to claim 9, wherein said strips are secured to said panels by stitching.

12. A cover according to claim 10, wherein said strips are secured to said panels by stitching.

13. A lightweight thermal cover or blanket for a swimming pool which is compactly foldable for storage comprising thin and flexible plastic sheeting, thin flexible strips of plastic sheet material secured to said plastic sheeting, said thin flexible strips having one side provided with a thin and flexible layer of closed cell foam material thereon, said strips being spaced over a major surface of said plastic sheeting and around peripheral edges thereof to provide reinforcement and flotation.

14. Blanket or cover according to claim 13, wherein said strips are secured to the said sheeting by stitching.

15. Blanket or cover according to claim 13, which is of circular or oval configuration, and wherein one of said strips is a peripheral strip of thin and flexible plastic sheet material having a thin and flexible layer of closed cell foam material provided thereon and is secured around a border of the cover on one side thereof.

16. Blanket or cover according to claim 13, which is of rectilinear configuration and wherein at least some of said strips of thin and flexible plastic sheet material around said peripheral edges and having thin and flexible layers of closed cell foam material provided thereon are secured to one side of the cover along edges thereof.

17. Blanket or cover according to claim 16, wherein at least some of said strips of the thin and flexible plastic sheet material extend across the cover from edge to edge on one side thereof.

18. Blanket or cover according to claim 13, wherein at least some of said strips of the plastic sheet material are secured to the sheeting on opposite sides thereof.

19. Blanket or cover according to claim 15, wherein at least one of said strips of thin and flexible plastic sheet material is secured peripherally around said border of said sheeting on an opposite side thereof.

20. Blanket or cover according to claim 16, wherein some of said strips of plastic material are secured to said sheeting around said edges thereof on an opposite side of said sheeting.

21. A lightweight thermal cover for a swimming pool which is compactly foldable for storage comprising panels of thin and flexible plastic sheeting secured together in edgewise relationship by thin and flexible strips of plastic sheet material, said strips overlapping edges of adjacent ones of said panels, one side of said strips having a thin and flexible layer of closed cell foam material provided thereon, and having additional strips of thin flexible plastic sheet material secured around peripheral edges of the cover, said strips and said additional strips providing reinforcement and flotation.

22. A lightweight thermal cover for a swimming pool which is completely foldable for storage comprising panels of thin and flexible plastic sheeting secured together in edgewise relationship by thin flexible strips of plastic sheet material, said strips being provided on both sides of said panels and overlapping edges of adjacent ones of said panels with one side of said strips having a thin and flexible layer of closed cell foam material provided thereon, and additional flexible strips of plastic material being secured around peripheral edges of the cover on both sides thereof, said strips and said additional strips providing reinforcement and flotation.

23. A cover according to claim 21, wherein said strips are secured to said panels by stitching.

24. A cover according to claim 22, wherein said strips are secured to said panels by stitching.

* * * * *